United States Patent [19]

Fischer

[11] 4,397,419

[45] Aug. 9, 1983

[54] GUIDING ELEMENT FOR TOY VEHICLES

[76] Inventor: Artur Fischer, Weinhalde 14-18, 7244 Tumlingen, Waldachtal 3, Fed. Rep. of Germany

[21] Appl. No.: 230,584

[22] Filed: Feb. 2, 1981

Related U.S. Application Data

[63] Continuation-in-part of Ser. No. 182,326, Sep. 12, 1980, abandoned.

[30] Foreign Application Priority Data

Sep. 12, 1979 [DE] Fed. Rep. of Germany ..... 2936751
Feb. 12, 1980 [DE] Fed. Rep. of Germany ..... 3005120

[51] Int. Cl.[3] ..... A63H 19/30
[52] U.S. Cl. ..... 238/10 F; 46/1 K
[58] Field of Search ..... 238/10 R, 10 A, 10 B, 238/10 C, 10 E, 10 F; 104/305, DIG. 1; 46/1 K; 246/415 A

[56] References Cited

U.S. PATENT DOCUMENTS 3,520,475 7/1970 Ernst ..... 238/10 F
3,680,777 8/1972 Arai ..... 238/10 E

FOREIGN PATENT DOCUMENTS 800545 11/1950 Fed. Rep. of Germany .... 238/10 R
839620 5/1952 Fed. Rep. of Germany .... 238/10 C
763528 2/1934 France ..... 238/10 R

*Primary Examiner*—Joseph F. Peters, Jr.
*Assistant Examiner*—Mitchell J. Hill
*Attorney, Agent, or Firm*—Michael J. Striker

[57] ABSTRACT

A guiding element for a toy vehicle has an elongated body portion with at least one longitudinal groove, a retaining member received in the groove of the body portion and bendable together with the latter so that it is fixed in each of a plurality of different positions and retains the body portion so that the latter can assume one of a plurality of curved shapes, and a plurality of slots extending from at least one side of the body portion and opening into the longitudinal groove so as to render the body portion bendable in one plane.

14 Claims, 2 Drawing Figures

GUIDING ELEMENT FOR TOY VEHICLES

CROSS-REFERENCE TO A RELATED APPLICATION

This application is a continuation-in-part of copending application Ser. No. 182,326 filed on Sept. 12, 1980 now abandoned.

BACKGROUND OF THE INVENTION

The present invention relates to a guiding element for toy vehicle models, which is composed of a synthetic profiled member bendable in one plane. More particularly, the present invention relates to such a guiding element which is formed as a synthetic plastic profiled member provided with two parallel longitudinal grooves, and has two wire bands which are received in the longitudinal grooves, are bendable together with the profiled member, and retain the latter in a respective curved position.

Structural assembly kits are known including a guiding element which is formed as a profiled member and has such a cross-section that it can bend in one plane. The synthetic plastic material of the profiled member possesses, however, elastic properties. Thereby, in order to form a guiding element with a curved shape, it is necessary to provide an additional shape-retaining structure. In order to provide for an individual configuration of the guiding element in a simple manner and without an additional shape-retaining structure, it was proposed in the parent application to insert wire bands in the longitudinal grooves of a profiled member, which can be bent together with the profiled member and at the same time retain the respective curved shape of the latter. The wire bands are constituted of a very soft low pulling-resistant metal which has almost no inherent elasticity. Thereby the wire bands can be bent and retained in each curved form very easily. The bending property in one plane of the synthetic plastic profiled member is attained by a rectangular cross-section of the profiled member, so that the latter has a small moment of resistance in the above-mentioned one plane. The wire band counteracts the elastic force taking place because of the elasticity of the synthetic plastic profiled member and fixes the latter in its curved position. The rectangular vertically elongated cross-section of the profiled member posesses, however, some disadvantages. There are some difficulties in placing the rails in the guiding element because the smaller side of the profiled member provides for only a small supporting face for the rails. Furthermore, the toy vehicle which is guided on the rails must have a relatively high wheel base, which makes necessary great proportions of the toy vehicle. Moreover, it is difficult to mount such a guiding element on a support.

SUMMARY OF THE INVENTION

Accordingly, it is an object of the present invention to provide a guiding element which avoids the disadvantages of the prior art.

In keeping with these objects, and with others which will become apparent hereinafter, one feature of the present invention resides, briefly stated, in a guiding element having an elongated body portion with at least one groove and a retaining member received in the groove, wherein means for rendering the elongated body portion bendable in one plane is formed by a plurality of slots extending at least from one side of the body portion and opening into the groove of the latter.

When the guiding element is designed in accordance with the present invention, it is possible to increase the supporting face of the synthetic plastic profile member without endangering its bending property. The slots reduce the moment of resistance of the profiled member over a portion of the cross-section When the guiding element has two grooves, two retaining members received in the grooves, and two pluralities of slots each extending from a respective one of the sides of the body portion, the slots of two pluralities extend from both sides of the body portion and further reduce the moment of resistance of the profiled member. The elastic or restoring force generated by the elasticity of the profiled member is respectively small and compensated by the inserted wire bands for retaining the curved shape of the body portion. The inventive construction allows to make wider the guiding element so that it can also be utilized as a roadway. Finally, the wide supporting face of the guiding element makes considerably simpler the construction and mounting of the guiding element on a supporting plate with the aid of double-side adherent tape, screws and the like.

In accordance with another feature of the present invention, an elongated projection may be provided between the wire bands received in the longitudinal grooves of the body portion. The elongated projection overlaps the wire bands in direction transverse to the direction of elongation. The projection can serve for guiding or controlling the toy vehicle model provided with sliding or rolling means which act upon the steering.

In accordance with still another feature of the present invention, each wire band may have an angular shape and two legs of which one leg overlaps the respective groove and has a plurality of slots arranged in alignment with the slots of the body portion. The wire bands which serve for retaining the curved shape of the body portion serve simultaneously as current-conductive tracks for the current supply of the toy vehicle model. The angular shape of the wire bands makes possible the current collection by the collector ring arranged on the bottom of the toy vehicle model, on the one hand, and provides for a relatively wide conductive track, on the other hand. Since the leg overlapping the groove is provided with the slots, the bending property of the guiding element is not undesirably affected.

In accordance with a further feature of the present invention, the body portion of the guiding element may be provided with longitudinal flanges arranged at the sides of the same. The flanges prevent sliding off of the sliding contacts from the wire bands serving as conductive tracks. Thereby, a reliable electrical contact is provided along the entire curved configuration of the guiding element.

Finally, in accordance with still a further feature of the present invention, a plurality of parts of the guiding element can be connected with one another by interengagement of an extension section of the wire band of one part with a receiving recess of the body portion of the other part, wherein the extension section can be bent off by the thickness of the wire bend, and the receiving recess can be pocket-shaped. In such a construction, both the mechanical connection and the electrical connection of the parts of the guiding element are simultaneously attained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The FIG. 1 of the drawing is a perspective view showing a guiding element in accordance with the invention.

DESCRIPTION OF A PREFERRED EMBODIMENT

Figure 1:
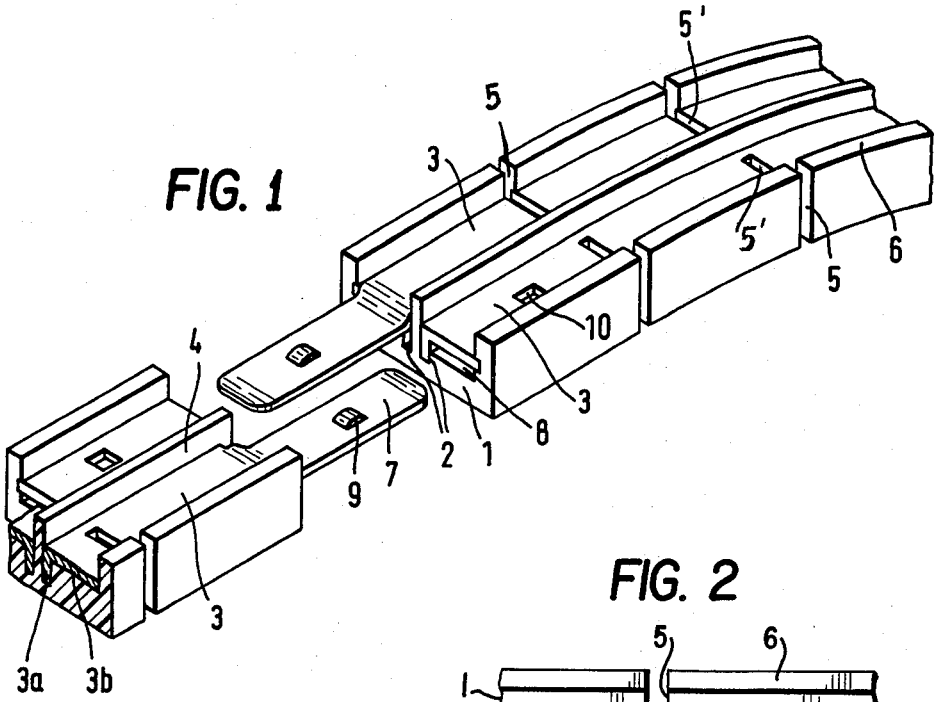

A guiding element in accordance with the present invention has a body portion which is identified by reference numeral 1 and is constituted of synthetic plastic material. The body portion 1 is provided with two longitudinal grooves 2 extending in direction of elongation of the body portion 1 and spaced from one another in a first transverse direction which is transverse to the direction of elongation. The body portion 1 has two sides spaced from one another in this first transverse direction. The retaining members which are identified by reference numeral 3 are inserted in the respective grooves 2.

Each retaining member 3 is formed as a wire band of an angular cross-section and has two legs identified by reference numerals 3*a* and 3*b*, respectively. A guiding projection 4 is arranged between the vertical legs 3*a* of the wire band. The guiding projection 4 is of one piece with a remaining section of the body portion 1 and extends upwardly outwardly beyond the wire band. In other words, the projection 4 extends transversely to the direction of elongation and also to the first transverse direction of the body portion 1.

Figure 2:
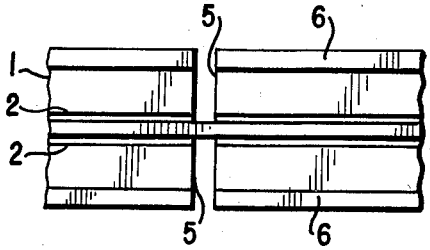
FIG. 2 is a plan view showing a fragment of the inventive guiding element without a retaining member.

The legs 3*b* of the wire bands extend horizontally from the vertical legs 3*a* outwardly in the above-mentioned first transverse direction transversely to the direction of elongation of the body portion 1 and to the direction of elongation of the bands 3. The legs 3*b* form simultaneously the conductive tracks on which the sliding contacts arranged on the lower slide of the toy vehicle can slide. The wire bands 3 are constituted of a soft and thereby easily bendable metal. The moment of resistance of the wire bands 3, on the one hand, and of the body portion 1, on the other hand, is considerably reduced in the following manner. The body portion 1 is provided with two groups of slots which are identified by reference numeral 5. The slots 5 of each group extend from the respective side of the body portion 1 inwardly of the latter and are open in the respective groove 2, as can be seen in FIG. 2. The wire bands are provided with a plurality of slots 5' which extend from the outer lateral side of the respective wire band inwardly of the same. Each slot 5 is arranged in alignment with a respective one of the slots 5' as considered in the first transverse direction.

The slots 5 and 5' make possible bending of the guiding element to any of a plurality of different curved shapes. The wire bands 3 have no elastic properties, and thereby the body portion 1 is retained in the required curved position by the wire bands 3. In such a construction, the guiding element can assume any desirable curved configuration.

The body portion 1 is provided with flanges arranged at both sides of the same and identified by reference numeral 6. The flanges project in a second transverse direction normal to the direction of elongation and also to the first transverse direction of the body portion 1. The flanges 6 provide for a lateral guidance for the sliding contacts, whereby slipping off of the sliding contacts during riding over curves is prevented.

Naturally, the guiding element can be composed of a plurality of the above-described members connected with one another electrically and mechanically. The electrical and mechanical connection can be performed in the following manner. The horizontal leg 3*b* of the wire band 3 inserted in the groove of one body portion is provided with an extension section 7, whereas the other body portion has a receiving recess 8 in which the extension section 7 can engage. The extension section 7 is offset relative to a remaining section of the same leg 3*b* by a distance corresponding to the thickness of the wire band. More particularly the extension section 7 is offset in the second transverse direction which is transverse to the direction of elongation and to the first transverse direction of the body portion 1. The receiving recess 8 is pocket-shaped and receives the thus offset extension section 7. The extension section 7 and the receiving recess 8 are arranged at the proximal ends of the respective parts to be connected. As can be seen from the drawing, the same end of one part to be connected can simultaneously be provided with the receiving recess 8 in the body portion 1 and the extension section 7 in the wire bend 3. Thereby a staggered-like connection is formed.

A springy projection or bridge 9 is provided on the extension section 7 of the horizontal leg 3*b* of the wire band 3. The wire band which is inserted in the body portion 1 provided with the receiving recess 8 has an opening 10 in which the springy projection 9 engages in the connected position of the two body parts 1. This improves the electric contact of the parts of the guiding element, on the one hand, and the mechanical connection of the parts with one another, on the other hand.

The slots 5 and 5' which render the guiding element bendable in one plane are shown as provided in a guiding element having two grooves and two wire bands. It is also possible to provide the same slots in a guiding element which has only one groove and one wire band received in the latter.

It will be understood that each of the elements described above, or two or more together, may also find a useful application in other types of constructions differing from the types described above.

While the invention has been illustrated and described as embodied in a guiding element for a toy vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A guiding element for a toy vehicle, comprising an elongated body portion which has at least one longitudinal groove extending in direction of elongation of said body portion and two sides spaced from one another in a first transverse direction which is transverse to the direction of elongation, said elongated body portion including a plurality of slots spaced from one another in the direction of elongation thereof so that because of said slots said elongated body portion can bend in one plane to assume a plurality of different curved shapes; and means for retaining said body portion when it assumes one of said curved shapes, said retaining means including at least one elongated retaining member which is received in said groove of said body portion and bendable to assume a plurality of different positions but is fixed in each of said positions, so that when said body portion is bent and assumes one of said curved shapes, said retaining member is also bent to and fixed in a respective one of said positions and thereby retains said one shape of said body portion, said retaining member having an angular cross-section and including two legs which extend in direction of elongation of said retaining member and are normal to one another.

2. A guiding element for a toy vehicle, comprising an elongated body portion which has two longitudinal grooves extending in direction of elongation of said body portion and spaced from one another in a first transverse direction which is transverse to the direction of elongation, and two sides also spaced from one another in the first transverse direction, said elongated body portion including two pluralities of slots formed in said body portion and spaced from one another in the direction of elongation thereof so that because of said slots said elongated body portion can bend in one plane to assume a plurality of different curved shapes, the slots of each of said pluralities extending from a respective one of said sides of said body portion and being open into a respective one of said longitudinal grooves; and means for retaining said body portion when it assumes one of said curved shapes, said retaining means including two elongated retaining members each received in a respective one of said grooves of said body portion and bendable to assume a plurality of different positions but fixed in each of said positions, so that when said body portion is bent and assumes one of said curved shapes, said retaining members are also bent to and fixed in a respective one of said positions and thereby retains said one shape of said body portion, each of said retaining members having an angular cross section and two legs which extend in the direction of elongation of said retaining members and are normal to one another, said two legs of each of said retaining members including a first leg which also extends in a respective one of said grooves in said first transverse direction and is provided with a plurality of slots which are in alignment with said slots of said first-mentioned plurality of slots and said second plurality of slots, respectively.

3. A guiding element as defined in claim 1, wherein said body portion has a second such longitudinal groove spaced from said first-mentioned longitudinal groove in said first transverse direction, said retaining means having a second such elongated retaining member received in said second groove, said body portion including a second such plurality of slots each extending from the other of said sides of said body portion and being open into said second groove.

4. A guiding element as defined in claim 3, wherein each of said slots of said first-mentioned plurality of slots is located in alignment with a respective one of said slots of said second plurality of slots as considered in said transverse direction.

5. A guiding element as defined in claim 3; and further comprising a projection extending in said direction of elongation of said body portion and located between said first-mentioned retaining member and second retaining member received in said first-mentioned and second grooves.

6. A guiding element as defined in claim 5, wherein said projection is of one piece with said body portion.

7. A guiding element as defined in claim 5, wherein said projection projects in a second transverse direction which is transverse to said direction of elongation of said body portion and to said first transverse direction and extends outwardly beyond said retaining members in said second transverse direction.

8. A guiding element as defined in claim 1, wherein said two legs of said retaining member includes a first leg which also extends in said groove in said first transverse direction and is provided with a plurality of slots which are in alignment with said slots of said body portion.

9. A guiding element as defined in claim 1, wherein each of said sides of said body portion has a flange section which extends in the direction of elongation of said body portion and projects in a second transverse direction which is normal to said direction of elongation of said body portion and said first transverse direction.

10. A guiding element as defined in claim 1, comprising a plurality of such body portions with such slots, and retaining means arranged so that said body portions are located one after the other in said direction of elongation; and further comprising means for connecting said body portions with one another, said connecting means including a receiving recess formed in one of said body portions, and an extension section formed on the retaining member in the other of said body portions and insertable into said receiving recess of said one body portion.

11. A guiding element as defined in claim 10, wherein said extension section is bent off relative to a reamining section of said remaining member in a second transverse direction which is normal to said direction of elongation of said body portion and said first transverse direction, said receiving recess of said one body portion being pocket-shaped.

12. A guiding element as defined in claim 11, wherein said retaining member of said other body portion has a predetermined thickness, said bent off extension section being offset relative to said remaining section by a distance corresponding to the thickness of said retaining member of said other body portion.

13. A guiding element as defined in claim 1, wherein said body portion is constituted of synthetic plastic material.

14. A guiding element as defined in claim 1, wherein said retaining member is a wire band.

* * * * *